US007159340B2

(12) United States Patent
Borsoi

(10) Patent No.: US 7,159,340 B2
(45) Date of Patent: Jan. 9, 2007

(54) BOOT FOR SPORTING ACTIVITIES

(75) Inventor: Bruno Borsoi, Vittorio Veneto (IT)

(73) Assignee: Salomon S.A., Metz-Tessy (FR)

( * ) Notice: Subject to any disclaimer, the term of this patent is extended or adjusted under 35 U.S.C. 154(b) by 69 days.

(21) Appl. No.: 10/664,833

(22) Filed: Sep. 19, 2003

(65) Prior Publication Data

US 2004/0074110 A1 Apr. 22, 2004

(30) Foreign Application Priority Data

Sep. 19, 2002 (FR) ..... 02 11873

(51) Int. Cl.

| | |
|---|---|
| ***A43B 5/04*** | (2006.01) |
| ***A43B 5/16*** | (2006.01) |
| ***A43C 11/00*** | (2006.01) |
| *A43B 3/10* | (2006.01) |

(52) U.S. Cl. ..... 36/50.1; 36/50.5; 36/10; 36/117.1

(58) Field of Classification Search ..... 36/50.1, 36/50.5, 116, 117.1, 10

See application file for complete search history.

(56) References Cited

U.S. PATENT DOCUMENTS

| | | | | | |
|---|---|---|---|---|---|
| 811,316 | A * | 1/1906 | McPherson | 36/50.1 |
| 4,811,500 | A * | 3/1989 | Maccano | 36/50.1 |
| 5,154,011 | A * | 10/1992 | Holzl et al. | 36/50.5 |
| 5,678,329 | A * | 10/1997 | Griffin et al. | 36/50.1 |
| 5,704,138 | A | 1/1998 | Donnadieu | |
| 5,909,947 | A | 6/1999 | DeMarchi | |
| 5,940,990 | A * | 8/1999 | Barret | 36/50.1 |
| 5,946,827 | A | 9/1999 | Okajima | |
| 5,966,841 | A * | 10/1999 | Barret | 36/50.1 |
| 6,128,836 | A * | 10/2000 | Barret | 36/50.1 |
| 6,405,457 | B1 | 6/2002 | Basso et al. | |
| 6,453,579 | B1 * | 9/2002 | Luprete | 36/50.1 |
| 6,560,898 | B1 * | 5/2003 | Borsoi et al. | 36/50.5 |
| 2003/0000111 | A1 * | 1/2003 | Basso | 36/55 |

FOREIGN PATENT DOCUMENTS

| | | |
|---|---|---|
| EP | 0521287 | 1/1993 |
| FR | 2770379 | 5/1999 |
| WO | WO 98/37782 | 9/1998 |

* cited by examiner

*Primary Examiner*—Anthony Stashick
(74) *Attorney, Agent, or Firm*—Greenblum & Bernstein, P.L.C.

(57) ABSTRACT

A boot having a sole and an upper, the boot extending longitudinally between a heel and a tip, the upper having an outer envelope and an inner envelope, the boot having a mechanism for tightening the inner envelope, the mechanism for tightening the inner envelope having keepers affixed to the inner envelope and at least one lace. The mechanism for tightening the inner envelope has at least one rear keeper affixed to the outer envelope, the rear keeper being located substantially toward the heel of the boot.

28 Claims, 4 Drawing Sheets

80
104
104
82
86
93
91
90
85
94
92
81

BOOT FOR SPORTING ACTIVITIES

CROSS-REFERENCE TO RELATED APPLICATION

This application is based upon French Patent Application No. 02.11873, filed Sep. 19, 2002, the disclosure of which is hereby incorporated by reference thereto in its entirety and the priority of which is hereby claimed under 35 U.S.C. §119.

BACKGROUND OF THE INVENTION

1. Field of the Invention

The present invention relates to a boot, particularly a sports boot, and more particularly to a boot adapted to be retained on a sports apparatus.

Boots of this type can be used in venues such as snowboarding, skiing, snowshoeing, walking on ice, roller skating, skateboarding, and the like.

2. Description of Background and Relevant Information

For certain sporting activities, it is advantageous that a boot be flexible.

In snowboarding, for example, a flexible boot makes it easier to walk or to perform style figures when steering a board.

As known, a boot extends longitudinally between a heel and a tip. The boot has a sole and an upper. Certain uppers have an outer envelope and an inner envelope, each having different characteristics. The outer envelope, for example, has a certain strength, waterproofness, or the like, whereas the inner envelope, for example, offers shock absorption, thermal comfort, or the like.

Generally, a mechanism for tightening the inner envelope can be provided. The tightening mechanism may include keepers that are affixed to the inner envelope, and a lace that runs through the keepers. Of course, the keepers are arranged such that a tensioning of the lace induces a tightening of the inner envelope. This enables the latter to better encircle the user's foot, and even the lower leg if the upper is a high upper.

Furthermore, a mechanism for tightening the outer envelope is generally provided. In this way, it is the entire upper that encircles the foot, and even the lower leg. On a boot of this type, and in spite of the double tightening system on the outer envelope and the inner envelope, it appears sometimes that the user's foot moves with respect to the upper when steering the apparatus. This is especially the case in snowboarding. The foot movements, particularly in the heel area, are interfering movements that disturb the steering of the apparatus. The steering impulses are not transferred directly or entirely from the user to the apparatus due to these interfering movements. This hinders the apparatus steering precision.

SUMMARY OF THE INVENTION

One of the objects of the invention is to improve the hold of the foot in a boot, particularly in the heel area.

To this end, the invention proposes a boot that has a sole and an upper, the boot extending longitudinally between a heel and a tip, the upper having an outer envelope and an inner envelope, the boot having a mechanism for tightening the inner envelope, the mechanism for tightening the inner envelope having keepers affixed to the inner envelope and at least one lace.

The tightening mechanism for tightening the inner envelope of a boot according to the invention has at least one rear keeper affixed to the outer envelope, the rear keeper being located substantially toward the heel of the boot. Thus, the foot is retained not only with respect to the inner envelope, but also with respect to the outer envelope with which the retention devices for the sports apparatus cooperate.

The structure of the tightening mechanism of the inner envelope enables a good retention of the inner envelope around the foot, and even around the lower leg if the upper is a high upper. The mechanism for tightening the inner envelope also enables a bias of the foot and/or of the inner envelope toward the heel of the boot.

An increase in the tensioning of the lace increases the support of the foot and/or of the inner envelope on the outer envelope in the direction of the heel. As a result, the user's foot is better retained in the boot, especially in the heel area. Thus, the movements of the foot in the boot are reduced when steering the apparatus. A resulting advantage is an increased steering precision.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The examples described hereinafter relate more particularly to snowboard boots. However, the invention applies to other fields, such as those mentioned above.

The first embodiment is described hereinafter with reference to FIGS. 1–3.

Figure 1:
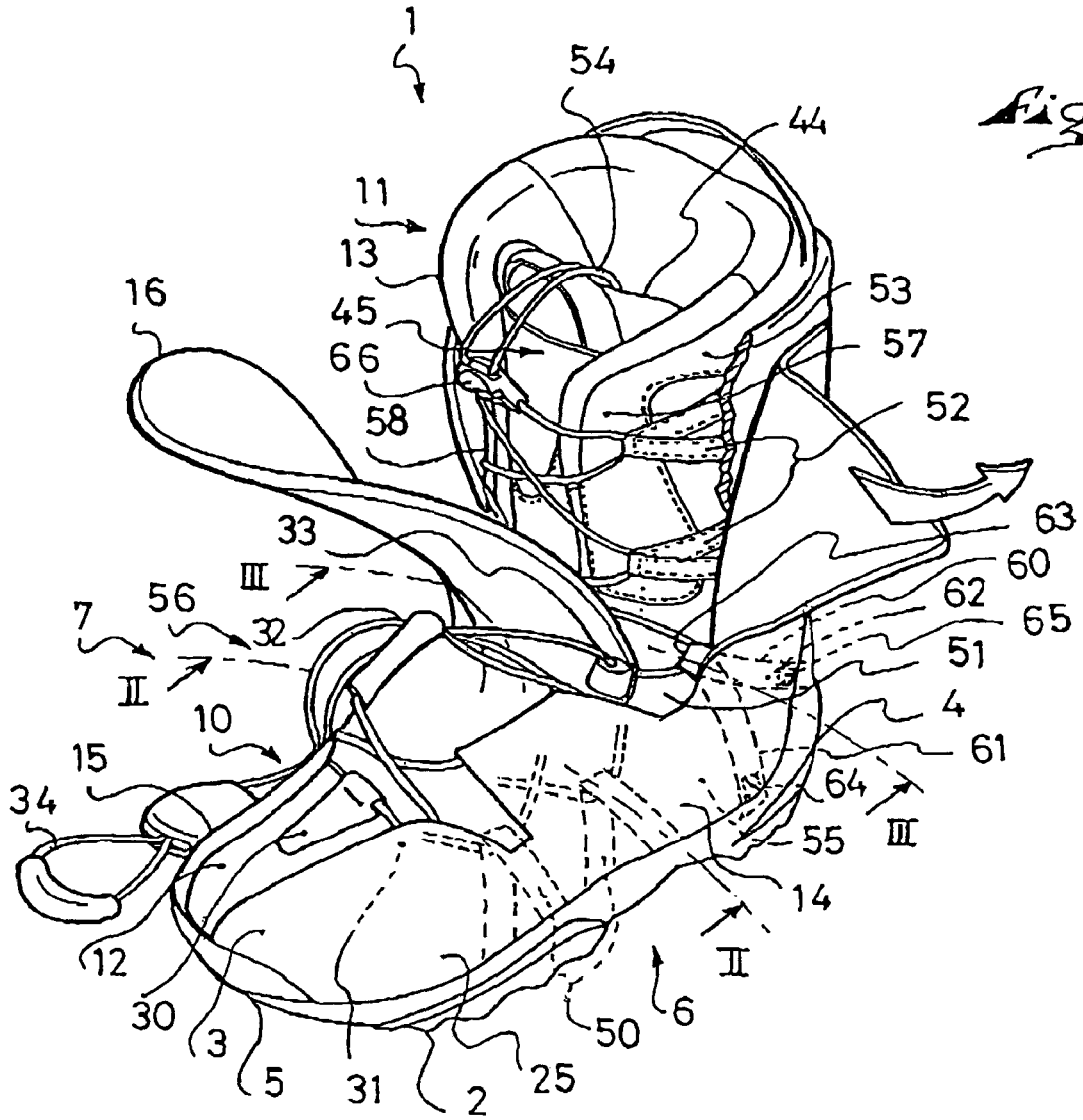
FIG. 1 is a perspective front view of a boot according to a first embodiment of the invention.

As shown in FIG. 1, a snowboard boot 1 is provided to receive the user's foot.

The boot 1 has a walking sole 2, i.e., an external sole, and an upper 3. The boot 1 extends lengthwise between a heel 4 and a tip 5, and widthwise between a lateral side 6 and a medial side 7.

As shown, the upper 3 has a lower portion 10 provided to surround the foot, and an upper portion 11 provided to surround a portion of the lower leg. However, the upper could also be provided to only have a lower portion.

The boot 1 is structured so as to enable a good foot rolling movement when walking, as well as inclinations of the lower leg when steering a board. Therefore, the sole 2 and the upper 3 are relatively flexible.

However, the boot could also be provided to be more rigid in order to facilitate certain steering styles or certain sporting activities.

The upper 3 has an outer envelope 12 and an inner envelope 13, the first surrounding the second.

Figure 2:
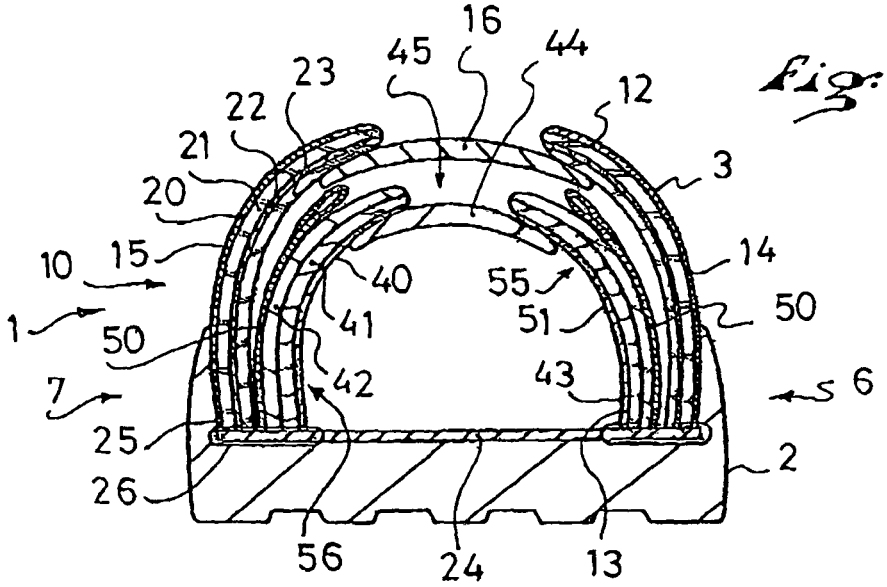
FIG. 2 is a cross-section along the line II—II of FIG. 1.
Figure 3:
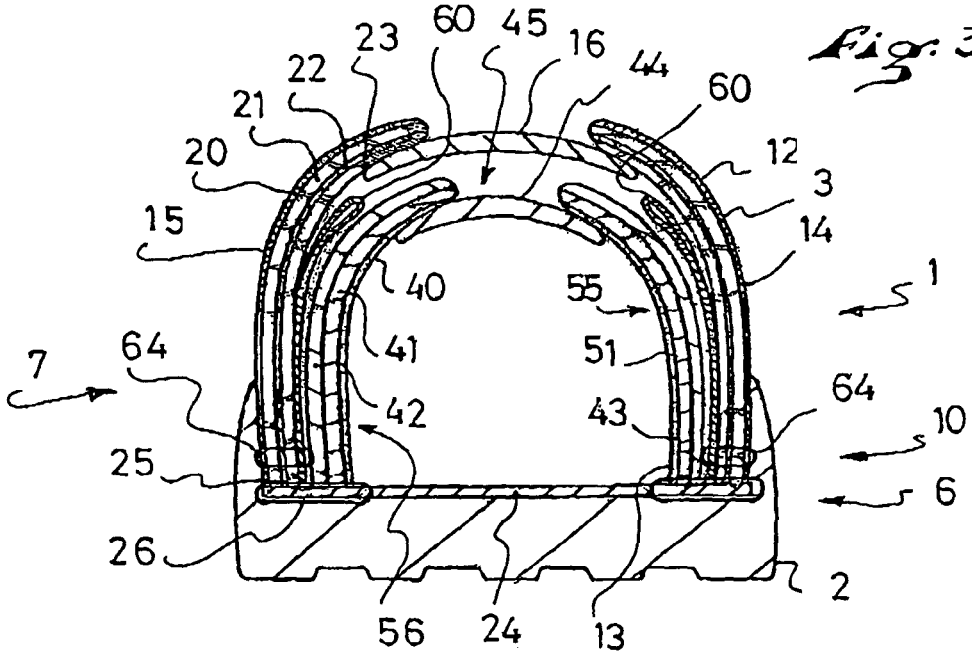
FIG. 3 is a cross-section along the line III—III of FIG. 1.

As shown better in FIGS. 2 and 3, the outer envelope 12 particularly has a lateral quarter 14, a medial quarter 15, and a tongue 16. The latter connects the quarters 14, 15 to one another in order to provide the outer envelope 12 with its continuity. However, one could provide not to use a tongue. In this case, the quarters 14, 15 can remain separated or can be superimposed. The outer envelope 12 is shown in the form of a stacking of layers including an outer layer 20, a core 21, an inner layer 22, and an inner lining 23.

The layers 20, 21, 22, 23 are made of materials that provide them with desired properties, such as resistance to wear and tear, imperviousness (such as to water and/or moisture), comfort, lightness, or the like. The number of layers can vary as a function of the materials used or the results desired.

The layers 20, 21, 22, 23 are assembled to one another by means such as gluing, stitching, or the like.

Preferably, an insole 24 is provided to maintain the outer envelope 12 in shape before it is mounted on the walking sole 2.

The outer envelope 12 is affixed by its base 25 to the insole 24 by a means shown in the form of stitching 26 (Strobel assembly). Another means, such as gluing, could be used (conventional assembly). However, stitching has the advantage of being relatively easy and quick to make.

Furthermore, the outer envelope 12 is affixed by its base 25 to the sole 2 in the area of the periphery of the sole. Preferably, the affixing is done by gluing. Nevertheless, another means, such as stitching, or the combination of gluing and stitching, could be used.

With reference again to FIG. 1, a first tightening mechanism is provided to tighten the outer envelope 12 reversibly.

The first tightening mechanism includes keepers 30, 31, 32, 33 arranged on the quarters 14, 15, of the outer envelope 12, and possibly in the vicinity of the tip 5 at the junction of the quarters.

Each keeper is shown in the form of a more or less long eyelet associated with the outer envelope 12. The eyelet can be made of molded plastic, for example. Other types of keepers can be used.

The first tightening mechanism further includes a lace 34 that follows a path marked by the keepers. For example, the lace 34 alternatively crosses a keeper of the lateral quarter 14 and a keeper of the medial quarter 15, in the lower portion 10 as well as in the upper portion 11 of the upper 3.

Other paths, as well, could be envisioned for the lace 34.

In any case, a tensioning of the lace 34 enables a tightening of the outer envelope 12, by bringing closer together the lateral quarter 14 and the medial quarter 15.

Other structures could be provided for the first tightening mechanism, such as a series of buckles, including loops controlled by levers on one side of the boot, and hooks for receiving the loops on the other side of the boot.

The inner envelope 13 is also described with reference to FIGS. 2 and 3.

The inner envelope 13 is shown in the form of a stacking of several layers including an inner layer 40, a core 41, and an outer layer 42.

Here again, the layers 40, 41, 42, are made of materials that provide them with desired properties. The layers 40, 41, 42 are also assembled to one another by any appropriate means.

The insole 24 can also be used to maintain the inner envelope 13 in shape before it is mounted on the sole 2.

The inner envelope 13 is affixed by its base 43 to the insole 24 by a means shown in the form of a stitching. The latter is preferably the same as the stitching 26 used for the outer envelope 12. Thus, a single means can be used to retain both the outer envelope 12 and the inner envelope 13 to the insole 24. This renders the manufacture easier and faster.

Again, another means, such as gluing, could be used.

The outer envelope 12 and the inner envelope 13 could be connected to one another by their respective bases 25, 43, independent of the sole 2. To this end, a means for attaching shown in the form of a stitching is provided. The latter is preferably the same as the stitching 26 that affixes the outer envelope 12 and the inner envelope 13 to the insole 24.

The means for affixing the bases 25, 43 to one another could be accomplished differently. For example, an adhesive or glue could be used, or yet the combination of stitching and adhesive/glue, or the like.

In the present case, given that the base 25 of the outer envelope 12 is affixed to the sole 2, and that the bases 25, 43 of the envelopes 12, 13 are affixed to one another, the base 43 of the inner envelope 13 is affixed to the sole 2.

In any case, the outer 12 and inner 13 envelopes face each other, substantially above their respective bases 25, 43, without being affixed to one another. They can be in contact with one another or slightly spaced apart, depending on the degree to which the outer envelope 12 is tightened.

Complementarily but not necessarily, a tongue 44 partially blocks at least one slit 45 of the inner envelope 13.

The fact that the inner envelope 13 is housed in the outer envelope 2 provides the upper 3 with a comfort that can be compared to that obtained with a liner. The fact that the inner envelope 13 is fixed by its base 43 to the base 25 of the outer envelope 12 and to the sole 2 provides the boot 1 with an aptitude to transmit the sensory information. Indeed, the base 43 is in a fixed position in relation to the sole 2, on the one hand, and the foot is in a more direct contact with the sole 2, on the other hand.

A second tightening mechanism is provided to tighten the inner envelope 13 in a reversible manner.

As seen in FIGS. 1 and 2, the second tightening mechanism has lower keepers 50 that are affixed to the lower portion 51 of the inner envelope 13, some of them being on the lateral side 6, others on the medial side 7.

Each lower keeper 50 is shown in the form of a loop associated with the inner envelope 13. The loop can be made with a folded flexible strap portion, for example. The inside of the loop can be fitted with a bushing/lining made of a material having a low friction coefficient, such as a plastic. Other types of keepers can be used.

The second tightening mechanism also has upper keepers 52 affixed to the upper portion 53 of the inner envelope 13, some of them being on the lateral side 6, others on the medial side 7.

Each upper keeper 52 is shown in the form of a loop associated with the inner envelope 13. The loop can be made with a flexible strap portion, with or without a bushing or lining, as mentioned above. Here again, other types of keepers can be used.

The tightening mechanism further has a lace 54 that follows a path marked out by the keepers. For example, the lace 54 alternatively crosses a keeper located on the lateral side 6 and a keeper located on the medial side 7, in the lower portion 51 as well as in the upper portion 53 of the inner envelope 13.

Other paths could be envisioned for the lace 54, as well.

In any case, a tensioning of the lace 54 enables a tightening of the inner envelope 13 by mutually bringing closer together a lower lateral quarter 55 and a lower medial quarter 56, and/or an upper lateral quarter 57 and an upper medial quarter 58 of the inner envelope 13.

According to the invention, as seen in FIGS. 1 and 3, the mechanism for tightening the inner envelope 13 has at least one rear keeper 60 that is affixed to the outer envelope 12, the rear keeper 60 affixed to the outer envelope 12 being located substantially toward the heel 4, or in the area of the heel 4, such as above the heel of the walking sole, of the boot 1. As shown in the drawings, the rear keeper is affixed to an inner surface of the outer envelope 12.

In the illustrated embodiment, although not necessarily, two rear keepers 60 are provided. One of the keepers is located on the lateral side 6 of the boot 1, on the lateral quarter 14 of the outer envelope 12. The other keeper is arranged on the medial side 7, on the medial quarter 15 of the outer envelope 12. Each of the rear keepers 60 is shown in the form of a folded strap portion to form a loop. The latter can be internally fitted with a bushing made of plastic, for example, in order to reduce the friction generated by the lace 54. Preferably, the strap portion of a rear keeper 60 is V-shaped. The portion is formed of first 61 and second 62 strands that are in the extension of one another, their junction corresponding to the fold 63 of the portion. The first strand 61 of the keeper 60 is affixed to the outer envelope 12 in the area of its base 25, along a means defined by a stitching 64. The stitching 64 is preferably located in the area of the base 25 of the outer envelope 12, in the vicinity of the insole 24. The stitching 64 is slightly forward of the heel 4. The second strand 62 of the keeper 60 is affixed to the outer envelope 12, slightly above the heel 4, along a means defined by a stitching 65. Preferably, the bisecting line of the V, formed by the strands 61, 62 is oriented substantially 45° with respect to the sole 2, or with respect to the upper portion 11 of the upper 3. This makes it possible to transfer the forces exerted on the rear keepers 60 more directly to the heel 4. Other means could be used, such as gluing, a passage in the slits of the outer envelope 12, or the like.

Moreover, one or all of the rear keepers 60 could be made differently, for example, in the form of an eyelet, a hook, snap, or the like.

In any case, the lace 54 of the second tightening mechanism runs through the lower keepers 50, the rear keepers 60, and the upper keepers 52. The lace 54 can be tightened by any means, such as a blocker 66, a knot, or the like.

The tensioning of the lace 54 naturally induces a tightening of the inner envelope 13. A supplemental effect is obtained due to the rear keepers 60. This is a bias of the inner envelope 13 and, implicitly, of the foot that it surrounds, toward the heel 4 of the boot 1. Depending on the location of the rear keeper(s) 60, the bias can be oriented differently. The bias can be oriented essentially toward the walking sole 2, or essentially toward the rear, along the length of the boot 1, or yet toward both the sole 2 and toward the rear.

In any case, the user's foot and the inner envelope 13 are pressed against the outer envelope 12 in the area of the heel 4. This translates into a better retention of the foot in the boot. A resulting advantage is a better transmission of the steering impulses and of the sensory information between the user and the driven apparatus, particularly when the boot is fixed to the sports apparatus via bindings that cooperate with the outer envelope. In other words, the steering precision is increased.

Figure 4:
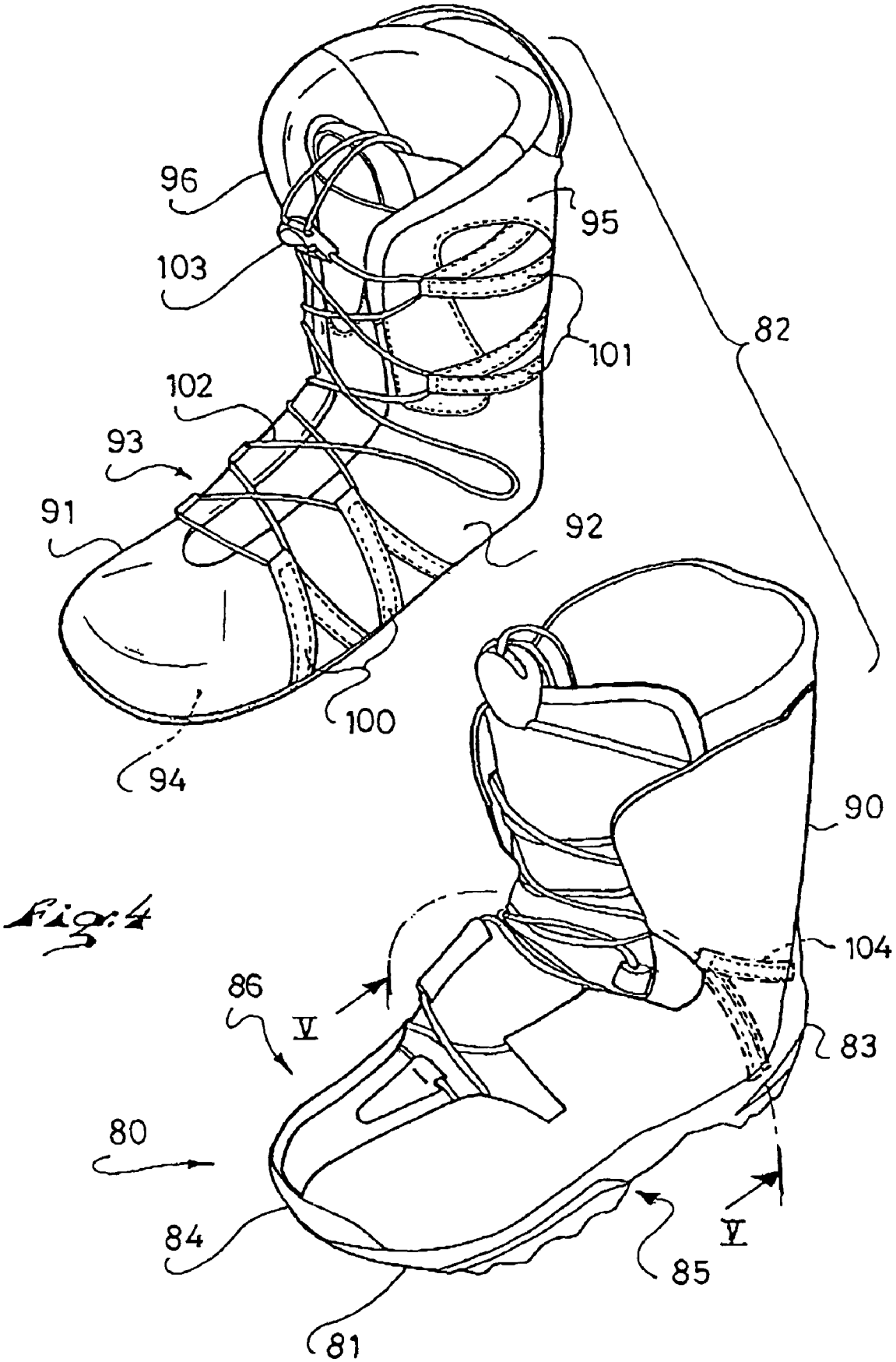
FIG. 4 is an exploded perspective front view of a boot according to a second embodiment of the invention.
Figure 5:
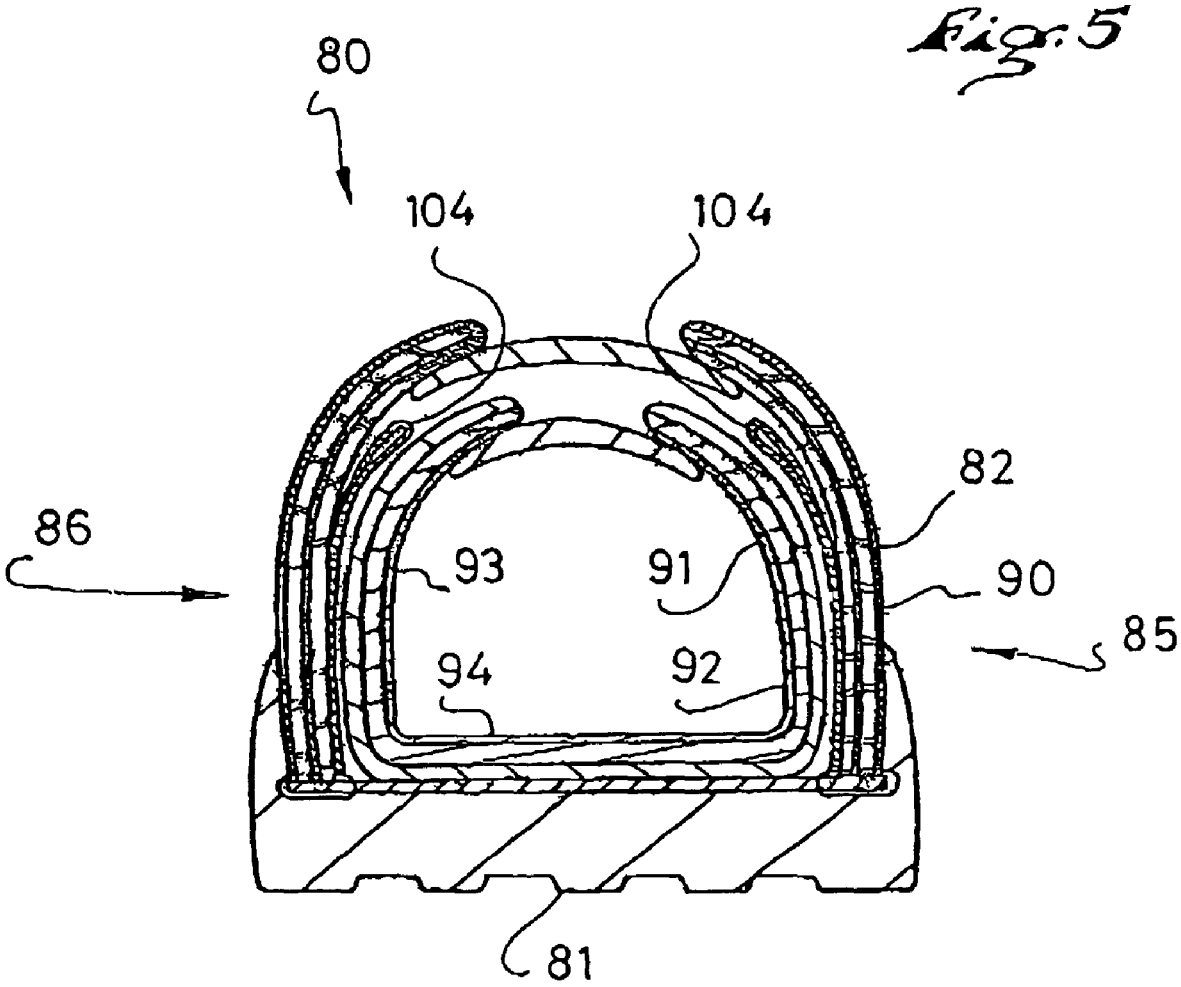
FIG. 5 is a cross-section along the line V—V of FIG. 4.

The second embodiment of the invention is described hereinafter with reference to FIGS. 4 and 5.

For reasons of convenience, only the differences with respect to the first embodiment are shown.

A boot 80 has a walking sole 81 and an upper 82. The boot 80 extends lengthwise between a heel 83 and a tip 84, and widthwise between a lateral side 85 and a medial side 86.

The upper 82 has an outer envelope 90 affixed to the sole 81, as well as a liner 91. The latter is removably mounted within the outer envelope 90. The liner 91 fulfills the function of an inner envelope of the upper 82. The liner 91 particularly has a lower lateral quarter 92 and a lower medial quarter 93 connected to one another by a base 94, as well as an upper lateral quarter 95 and an upper medial quarter 96.

The liner 91 is also provided with a tightening mechanism which includes lower keepers 100, upper keepers 101, a lace 102, and a tying device shown in the form of a blocker 103.

According to the invention, at least one rear keeper 104 affixed to the outer envelope 90 has also been provided for the tightening mechanism for the inner envelope constituted by the liner 91. Here again, each rear keeper 104 is located substantially toward the heel 83, or in the area of the heel 83, such as above the heel of the walking sole, of the boot 80. As shown in the drawings, the rear keeper 104 is affixed to an inner surface of the outer envelope 90.

All of the keepers 100, 101, 104 are shown in the form of loops made with folded strap portions. However, the rear keeper 104 is preferably open permanently or occasionally so that the liner 91 can be inserted into or removed from the envelope 90. The rear keeper 104 can have the shape of a hook, or the appearance of a snap that is opened by a finger journalled against the action of an elastic mechanism. A tensioning of the lace 102 causes the tightening of the liner 91, as well as a bias of the liner and of the foot toward the heel 83 due to the rear keepers 104.

It can be noted that there are two rear keepers 104, one being located on the lateral side 85, the other on the medial side 86.

In any case, the invention is made from materials and according to implementation techniques known to one with ordinary skill in the art.

The invention is not limited to the particular embodiments described hereinabove, and encompasses all of the technical equivalents that fall within the scope of the claims that follow.

In particular, the number of rear keepers can vary. There could be a single rear keeper, either on the lateral side or on the medial side. Consequently, the bias exerted by the lace on the inner envelope would be offset either on the lateral side or on the medial side.

There could also be a plurality of rear keepers on the same lateral or medial side.

What is claimed is:

1. A boot comprising:

an external sole and an upper, the boot extending longitudinally between a heel and a tip;

the upper including an outer envelope and an inner envelope, the outer envelope being affixed to the external sole;

a mechanism for tightening the inner envelope, the mechanism for tightening the inner envelope including at least one lace and keepers affixed to the inner envelope;

the mechanism for tightening the inner envelope further including at least one rear keeper affixed to the outer envelope substantially in an area of the heel of the boot, said lace extending through said at least one rear keeper and through a plurality of said keepers affixed to the inner envelope;

the mechanism for tightening the inner envelope does not include any keeper affixed to the outer envelope forward of a forwardmost one of said at least one rear keeper affixed to the outer envelope.

2. A boot according to claim 1, further comprising:

an insole to maintain shapes of the outer envelope and the inner envelope, the outer envelope and the inner envelope being affixed to the insole at respective bases.

3. A boot according to claim 1, wherein:

the outer envelope and the inner envelope are connected to one another by respective bases.

4. A boot according to claim 1, wherein:

the inner envelope is a liner removably mounted within the outer envelope.

5. A boot according to claim 1, wherein:

the least one rear keeper comprises two rear keepers, one of the two rear keepers being located on a lateral side on a lateral quarter of the outer envelope, another of the two rear keepers being located on a medial side on a medial quarter of the outer envelope.

6. A boot according to claim 1, wherein:

the rear keeper is a folded strap portion to form a loop, the portion being V-shaped, the portion being formed of first and second strands affixed to the outer envelope at spaced apart locations, the first strand being affixed to the outer envelope slightly forward of the heel, the second strand being affixed to the outer envelope rearward of the first strand and slightly above the heel.

7. A boot according to claim 1, wherein:

the upper includes a lower portion provided to surround the foot, and an upper portion provided to surround a portion of a user's lower leg.

8. A boot according to claim 1, wherein:

the at least one rear keeper is affixed to the outer envelope in the area of the heel of the boot.

9. A boot according to claim 1, wherein:

the at least one rear keeper is affixed to an inner surface of the outer envelope in the area of the heel of the boot.

10. A boot according to claim 1, wherein:

said outer envelope is relatively flexible for facilitating walking and inclinations of a wearer's lower leg.

11. A boot according to claim 1, wherein:

the outer envelope is affixed to the external sole by means of an adhesive and/or stitching.

12. A boot according to claim 1, wherein:

the rear keeper comprises a strap affixed against an inner surface of the outer envelope.

13. A boot according to claim 1, wherein:

said one lace of the mechanism for tightening the inner envelope comprises a first lace;

the boot further comprising a mechanism for tightening the outer envelope, the mechanism for tightening the outer envelope including a second lace and a plurality of keepers affixed to the outer envelope, said plurality of keepers affixed to the outer envelope being additional to said rear keeper and additional to said keepers affixed to the inner envelope.

14. A boot according to claim 1, wherein:

the inner envelope of the upper includes a lower portion provided to surround the foot, and an upper portion provided to surround a portion of a User's lower leg;

the outer envelope of the upper includes a lower portion provided to surround the foot, and an upper portion provided to surround a portion of the user's lower leg;

said keepers affixed to the inner envelope comprises a first plurality of keepers affixed to the lower potion of the inner envelope and a second plurality of keepers affixed to the upper portion of the inner envelope;

said lace extends successively through keepers of said first plurality, through said at least one rear keeper, and through keepers of said second plurality.

15. A boot according to claim 1, wherein:

the keepers affixed to the inner envelope and the at least one rear keeper affixed to the outer envelope are loops associated with the inner envelope and the outer envelope, respectively.

16. A boot according to claim 15, wherein:

the loops of the keepers are made with folded strap portions.

17. A snowboard boot comprising:

an external sole and an upper, the boot extending longitudinally between a heel and a tip;

the upper including an inner envelope and a flexible outer envelope, the outer envelope being affixed to the external sole and having a flexibility for facilitating walking when not mounted on a snowboard and for facilitating inclinations of the upper while steering a snowboard;

a mechanism for tightening the inner envelope, the mechanism for tightening the inner envelope including at least a first lace and a plurality of keepers affixed to the inner envelope;

the mechanism for tightening the inner envelope further comprising a mechanism for both retaining a wearer's foot with respect to the inner envelope and retaining the wearer's foot with respect to the outer envelope, said mechanism including at least one rear keeper affixed to the outer envelope substantially in an area of the heel of the boot, said first lace extending through said at least one rear keeper and through a plurality of said keepers affixed to the inner envelope;

a mechanism for tightening the outer envelope the mechanism for tightening the outer envelope including a second lace and a plurality of keepers affixed to the outer envelope, said plurality of keepers affixed to the outer envelope being additional to said rear keeper and additional to said keepers affixed to the inner envelope.

18. A snowboard boat according to claim 17, wherein:

the inner envelope is a removable liner not glued or stitched within the snowboard boot.

19. A snowboard boot according to claim 17, wherein:

the least one rear keeper comprises two rear keepers, one of the two rear keepers being located on a lateral side on a lateral quarter of the outer envelope, another of the two rear keepers being located on a medial side on a medial quarter of the outer envelope.

20. A boot according to claim 17, wherein:

the rear keeper is a folded strap portion to form a loop, the portion being V-shaped, the portion being formed of first and second strands affixed to the outer envelope at spaced apart locations, the first strand being affixed to the outer envelope slightly forward of the heel, the second strand being affixed to the outer envelope rearward of the first strand and slightly above the heel.

21. A boot according to claim 17, wherein:

the upper includes a lower portion provided to surround the wearer's foot, and an upper portion provided to surround a portion of the wearer's lower leg.

22. A boot according to claim 17, wherein:

the outer envelope of the upper includes a lower portion provided to surround the wearer's foot and an upper portion provided to surround a portion of the wearer's lower leg;

the inner envelope of the upper includes a lower portion provided to surround the wearer's foot and an upper portion provided to surround a portion of the wearer's lower leg;

the keepers affixed to the inner envelope comprise a first plurality of keepers affixed to the lower portion of the inner envelope and a second plurality of keepers affixed to the upper portion of the inner envelope;

said first lace extends successively through keepers of said first plurality, through said at least one rear keeper, and through keepers of said second plurality.

23. A snowboard boot according to claim 17, wherein:

the at least one rear keeper is affixed to an inner surface of the outer envelope in the area of the heel of the boot.

24. A snowboard boot according to claim 17, wherein:

the outer envelope is affixed to the external sole by means of an adhesive and/or stitching.

25. A boot according to claim 17 wherein:

the rear keeper comprises a strap affixed against an inner surface of the outer envelope.

26. A boot according to claim 17, wherein:

the mechanism for tightening the inner envelope does not include any keeper affixed to the outer envelope forward of a forwardmost of said at least one rear keeper affixed to the outer envelope.

27. A snowboard boot according to claim 17 wherein:

the keepers affixed to the inner envelope and the at least one rear keeper affixed to the outer envelope are loops associated with the inner envelope and the outer envelope, respectively.

28. A boot according to claim 27, wherein:

the loops of the keepers comprise folded strap portions affixed to the outer envelope substantially in the area of the heel of the boot.

* * * * *